US005918386A

United States Patent [19]

Marmonier

[11] Patent Number: 5,918,386

[45] **Date of Patent: *Jul. 6, 1999**

[54] SNOWBOARDING SHOE

[75] Inventor: Gilles Marmonier, Saint Etienne de Crossey, France

[73] Assignee: Skis Rossignol S.A., France

[ * ] Notice: This patent issued on a continued prosecution application filed under 37 CFR 1.53(d), and is subject to the twenty year patent term provisions of 35 U.S.C. 154(a)(2).

[21] Appl. No.: 08/823,319

[22] Filed: Mar. 21, 1997

[30] Foreign Application Priority Data

Mar. 22, 1996 [FR] France ..... 96 03838

[51] Int. Cl.[6] ..... A43B 5/00

[52] U.S. Cl. ..... 36/117.3; 36/115

[58] Field of Search ..... 36/117.3, 117.1, 36/115

[56] References Cited

U.S. PATENT DOCUMENTS

| | | | |
|---|---|---|---|
| 5,054,807 | 10/1991 | Fauvet | 280/607 |
| 5,156,644 | 10/1992 | Koehler et al. | 280/14.2 |
| 5,299,823 | 4/1994 | Glaser | 280/625 |
| 5,520,406 | 5/1996 | Anderson et al. | 280/624 |
| 5,657,558 | 8/1997 | Pohu | 36/131 |

FOREIGN PATENT DOCUMENTS

| | | |
|---|---|---|
| 2705248 | 8/1994 | France . |
| 2733671 | 10/1995 | France . |
| 2738751 | 1/1997 | France . |
| 9426365 | 3/1994 | WIPO . |
| 96 01575 | 1/1996 | WIPO . |

*Primary Examiner*—M. D. Patterson

*Attorney, Agent, or Firm*—Wall Marjama Bilinski & Burr

[57] ABSTRACT

A snowboarding shoe comprising an upper portion and a sole having a central portion. The central portion includes a housing and components for interacting with a binding located on a snowboard. An adaptation piece is removably secured to the housing. The adaptation piece is configured to receive the components for interacting with the binding.

11 Claims, 4 Drawing Sheets

35
34
30
32
31
33
23
25
26
29
20
21
28
27
22
24
5
8
10
6
7
9
14
3
11
2
1

SNOWBOARDING SHOE

CROSS REFERENCE TO RELATED APPLICATION

Reference is made to and priority claimed from French Patent Application No. 96 03838 filed Mar. 22, 1996, entitled "Snowboarding Shoe".

FIELD OF THE INVENTION

The invention concerns the field of gliding sports, and more particularly that of snowboarding. It more precisely relates to an improvement to shoes allowing the practice of this sport.

BACKGROUND OF THE INVENTION

As is known, shoes allowing the practice of snowboarding can be classed in three main categories, having very different mechanical qualities.

Thus, hard boots are known, which are similar to the boots intended for the practice of downhill skiing and consist mainly of a rigid shell and a sole interacting with a binding that either consists of a front fastening and an articulated back binding, or is formed by a system with retractable lugs allowing the shoe to be fitted automatically. This type of hard boot is relatively uncomfortable for walking.

In addition, soft snowboarding boots are known, consisting essentially of a leaktight boot intended to be gripped in a binding which consists mainly of a back spoiler, allowing dynamic support, and straps which secure the boot to the binding. Dynamic support with a soft boot of this type is not optimal.

A third category of shoe is also known, combining the qualities of the two aforementioned classes, these consisting of the assembly of a flexible upper with an inner frame which is used for providing dynamic support and for securing to the board using components arranged in the central portion of the sole. In particular, this type of design forms the subject matter of document FR-A-2 733 671 of the Applicant.

Moreover, as regard, the components for interacting with the binding, a number of architectures and geometries have so far been proposed. Thus, there is a particular known geometry which is in the form of a frustroconical block interacting with sliding jaws of the binding. In addition, patent FR-A-2 738 751, discloses shoes having lateral extensions in the central portion of the sole, which are intended to allow the shoe to be secured to a transverse binding. In addition, patent WO 94/26365 discloses a shoe which, in the central portion of the sole, includes two offset lateral pins which are oriented substantially along the longitudinal axis of the shoe and are intended to interact with a specific binding. Further to this, patent FR 2 705 248 discloses a binding which is produced by means of a longitudinal pin arranged under the sole, substantially level with the arch of the foot, this pin being hooked by a jaw of the binding.

Thus, there is a wide variety of means for securing the shoe to the snowboard. The consequence of this is that a pair of shoes is dedicated to a particular snowboard having specific bindings. This presents a number of major drawbacks, namely, on the one hand for the user, the need to change shoes when he desires to change snowboard and, on the other hand for the manufacturer, the requirement of producing as many types of shoes as there are existing bindings.

The problem which the invention therefore proposes to solve is that of the compatibility of snowboarding shoes with the large number and great variety of bindings existing on the market.

SUMMARY OF THE INVENTION

The invention therefore relates to a snowboarding shoe of known type, including an upper associated with a sole, in which, in its central portion, the sole has components for interacting with a binding located on the snowboard.

This shoe is one wherein in its central portion, the sole has a housing in which an adaptation piece, intended, under its lower face, to receive the components for interacting with the binding, is removably arranged.

In other words, the invention consists in forming, under the sole of the shoe, a cavity into which an intermediate wedge can be inserted, the lower profile of which allows either the fitting of various bases for interacting with the binding, or direct interaction with the binding.

In this way, using one type of shoe, and by changing only the adaptation piece, the shoe can be made compatible with a large number of bindings.

Advantageously, and in order to facilitate manufacturing of the shoe and, in particular, release of the sole from the mold when it is manufactured by injection, the housing opens laterally on the two sides of the sole.

In order to ensure easy fitting and to avoid any risk of slipping, the front and rear sides of the adaptation piece are convex, that is to say curved respectively toward the front and toward the rear of the shoe. Thus, by virtue of these interlocking shapes, the adaptation piece can receive large components for interacting with the binding.

In a preferred form, the front and rear sides of the adaptation piece are circumscribed by the same cylindrical or conical surface so as to allow rotation of the adaptation piece in the housing. In this way, the user can adjust the angular position of the components for interacting with the binding, with respect to the longitudinal axis of the shoe, and thus modify the orientation of his feet on the snowboard without acting on the bindings.

Advantageously, in practice, the housing has a diameter of between one hundred and five millimeters and one hundred and twenty millimeters, and a depth of between fifteen millimeters and twenty millimeters, and preferably equal to eighteen millimeters.

Advantageously, in practice, in one embodiment on its lower face, the adaptation piece has hollowed parts intended, at least in part, to receive the components for interacting with the bindings.

Thus, these binding components are fully or partially fitted into the adaptation wedges, which makes it possible, on the one hand, to obtain more efficient attachment and, on the other hand, to reduce the overall bulk of the shoe.

In practice, the sole has a plurality of sets of holes allowing the securing of the interaction components, through the corresponding sets of holes made through the adaptation piece.

In a preferred form, the interaction components, and therefore the adaptation piece, are secured to a rigid element arranged inside the shoe, above the sole.

In a first embodiment, the components for interacting with the binding consist of a block, of rectangular general shape, protruding laterally on each side of the sole. In other words, the active parts of the interaction components consist of a pair of lateral extensions of the sole.

In a second embodiment, these components for interacting with the binding consist of a set of two offset pins which are oriented substantially along the longitudinal axis of the shoe and are connected by an openworked plate fitted into the adaptation piece.

In a third embodiment, the components for interacting with the binding consist of two lateral recesses which are hollowed into the side faces of the adaptation piece.

Advantageously, the lateral recesses are formed by inserts which are made of a material with a greater hardness than the rest of the adaptation piece.

BRIEF DESCRIPTION OF THE DRAWINGS

The way in which the invention is embodied, and the advantages which result therefrom, will emerge clearly from the description of the following embodiments, supported by the appended figures, in which.

DETAILED DESCRIPTION OF THE INVENTION

Figure 1:
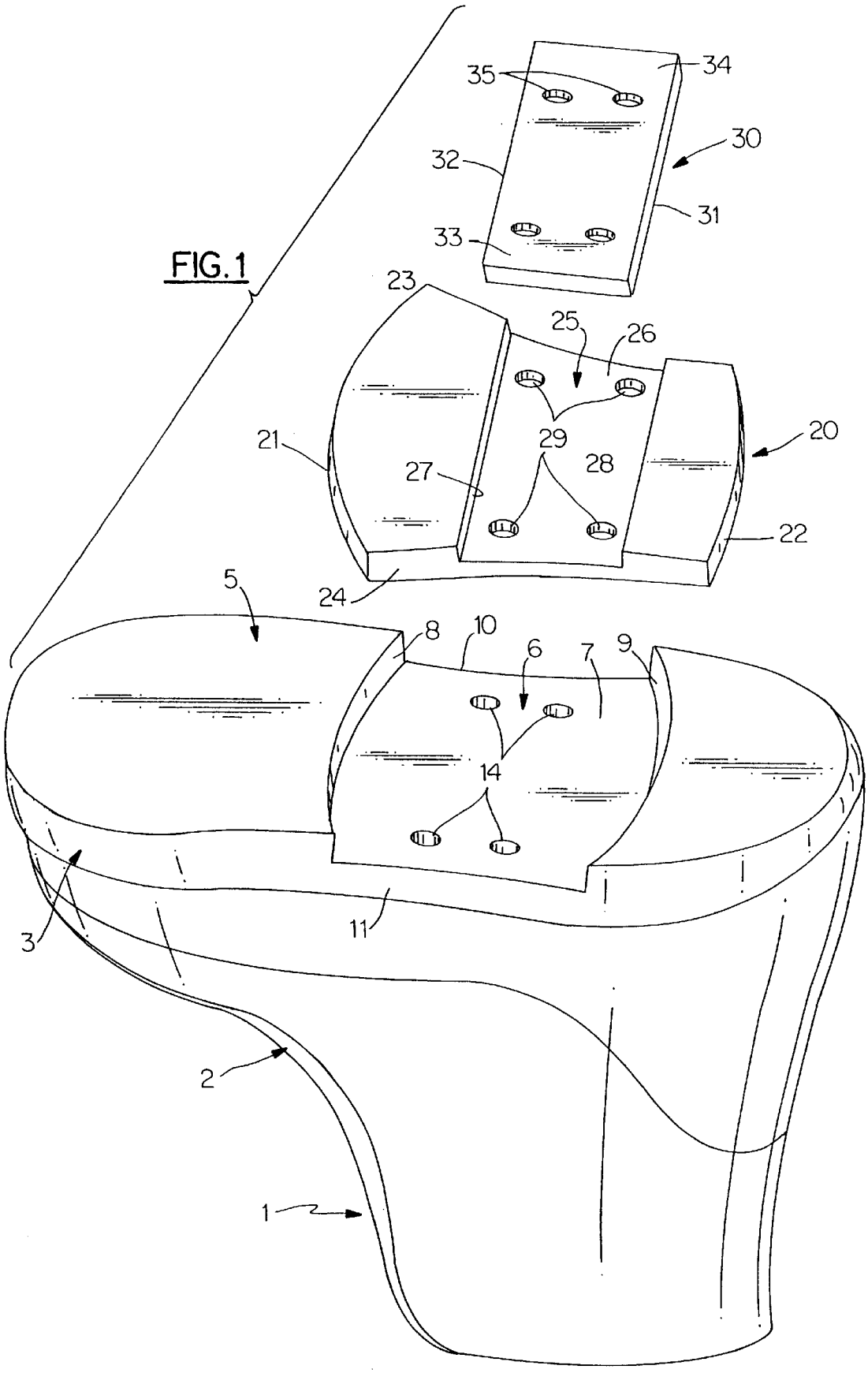
FIG. 1 is an exploded perspective view of a shoe according to the invention.

In the rest of the description, in order to facilitate understanding, the choice has been made to describe a shoe placed via its sole on a horizontal support.

As stated above, the invention relates to a snowboarding shoe (1), of known type, mainly including a flexible upper (2) and a sole (3), typically made of injected plastic.

One of the objects of the invention is to allow a given shoe to be fitted onto various types of binding. This object is achieved by using an adaptation piece inserted into a housing (6) arranged level with the arch of the shoe.

More precisely, in a practical embodiment, this housing (6) includes a plane upper face (7) and is bordered by two vertical steps, respectively front (8) and rear (9). These steps (8, 9) are curved so as to give the housing (6) a convex shape with maximum surface area. Of course, the invention also encompasses the variants in which the upper face (6) is not plane but assumes a shape allowing interaction or interpenetration of the adaptation piece with the sole.

In complementary fashion, in the preferred form, the housing (6) opens on the two sides of the sole (3) through two openings (10, 11). Therefore, according to the invention, this housing (6) receives an adaptation piece (20) forming a wedge intended to receive the components (30) for interacting with the binding proper.

Figure 2:
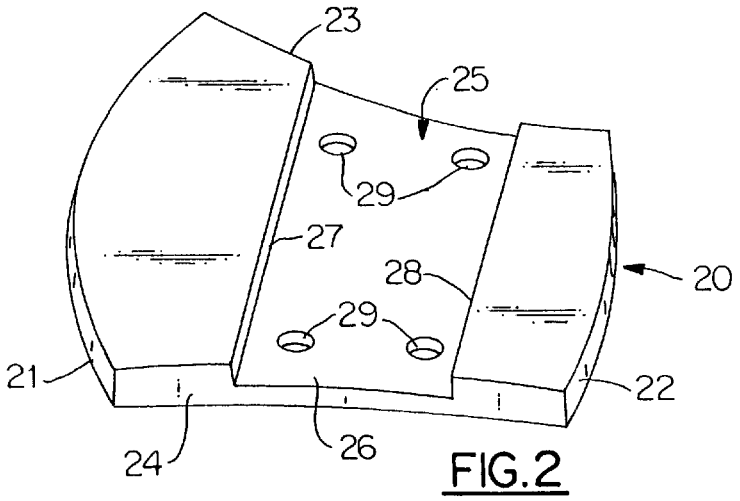
FIGS. 2, 3, 4 and 5 are outline perspective views of adaptation pieces according to three alternative embodiments.

Thus, as illustrated in FIG. 2, in an alternative embodiment this adaptation piece (20) has a front side (21) whose curvature is complementary with the heel step (8) of the housing and is therefore bent in the direction of the toe (5) of the sole (3). Conversely, the rear side (22 of this adaptation piece (20) is itself bent in the direction of the heel (4) of the sole. The two lateral sides (23 and 24) have profiles allowing them to be placed flush in the openings (10, 11) of the housing (6).

In a preferred form, the adaptation piece (20) is, via its front (21) and rear (22) sides, circumscribed by a cylinder, which makes it possible to adjust the angular position of the components for interacting with the binding, with respect to the longitudinal axis of the foot, and thereby that of the foot on the snowboard, without having to act on the binding proper. In other words, the sides (21) and (22) of the adaptation piece (20) have an identical curvature and their centers of curvature coincide.

In practice, it has been determined that the diameter, making it possible to accommodate a maximum number of binding types while remaining compatible with the constraints regarding rigidity and manufacturing of the shoe, should be between 105 and 120 millimeters, and that the associated depth of the housing should be between 15 and 20 millimeters, and preferably close to 18 millimeters.

In a different embodiment, the adaptation piece (20) is circumscribed, by its front (21) and rear (22) edges, in a cone whose virtual vertex is located under the shoe. In other words, the housing (6) has undercuts which oppose detachment of the adaptation piece (20) and thus ensure proper support of the characteristic elements.

Specifically relating to the form illustrated in FIG. 2, the wedge (20) has a transverse recess (25) whose transverse sides (27, 28) are parallel to each other and are perpendicular to the longitudinal axis of the shoe. The side edges of this housing (25) open laterally into the openings (10, 11) of the housing (6). The upper face (26) of this housing (25) is intended to receive the interaction components which the block (30) constitutes.

This block (30), corresponding to a first type of binding, assumes a general rectangular shape whose width corresponds to that of the housing (25) of the adaptation piece (20). The extreme parts (33, 34) of the block (30) are intended to protrude from the housing (25) of the adaptation piece (20), and consequently from the housing (6) of the sole (3). In order to secure this block (30) to the sole (20), the block may include a plurality of holes (35), in which securing components are inserted, for example screws, rivets, or internally threaded rivets, which cross the adaptation piece (20) through a set of holes (29), before being anchored inside the sole (3) through the set of holes (14).

As regards the anchoring of the block (30), this may be done directly in the sole (3) or, in a preferred form, inside a reinforcing element (50) which is arranged inside the shoe, above the sole (3), and which may advantageously form part of an articulated frame such as the one described, in particular, in document FR 95.05615 of the Applicant, not published at the filing date of the present application. Advantageously, this reinforcement does not extend beyond the region of the metatarsophalangeal joint, in order to allow the foot to flex during walking.

Figure 3:
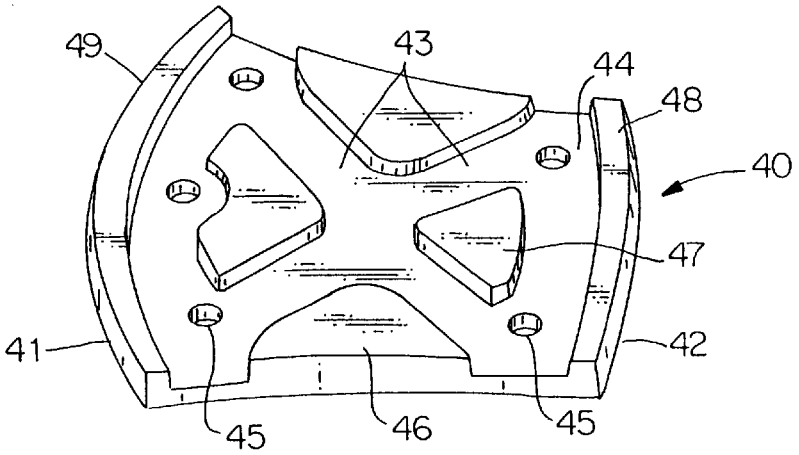

The essential advantage of the snowboarding shoe according to the invention is that it allows the adaptation of various components for interacting with the binding, by modifying only the adaptation piece inserted into the housing (6). To this end, the adaptation piece (40) illustrated in FIG. 3 has an outer contour identical to the adaptation piece (20) in FIG. 2. More precisely, the front (41) and rear (42) edges of this adaptation piece (40) also coincide with the vertical steps (8) and (9) of the housing (6) of the sole (3). This adaptation piece (40) can therefore be substituted for the adaptation piece (20).

Figure 9:
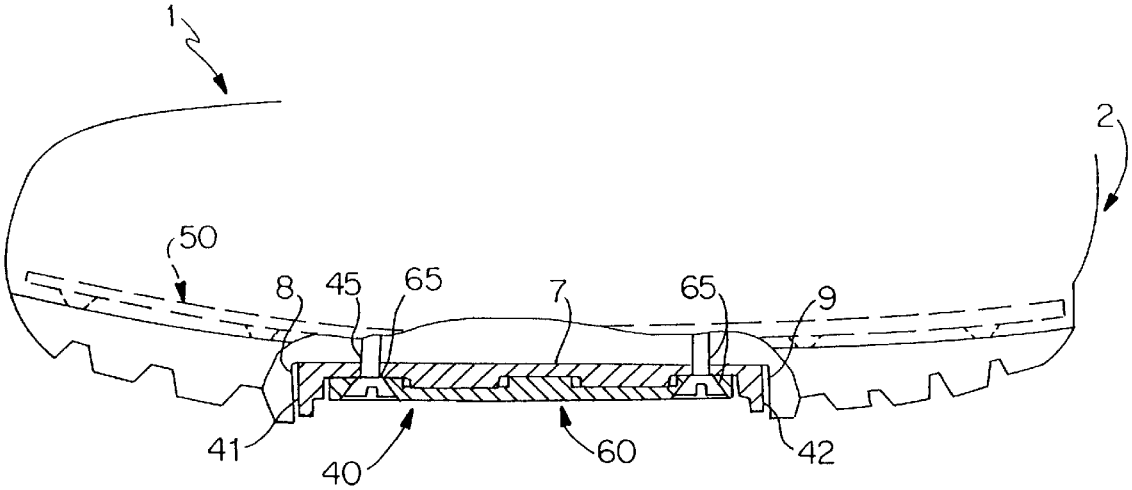
FIG. 9 is a longitudinal section of a sole receiving the adaptation piece and the components for interacting with the binding.

In order to make it possible to fit components (60) for interacting with the binding, as illustrated in FIG. 9, the wedge (40) has a plurality of recesses (43, 44) in which the component (60) for interacting with the binding proper is fitted. More precisely, the recesses (43) form a cross along the diagonals of the adaptation piece (40) while the channels (44) follow the front and rear edges (41, 42) of this same adaptation piece. The protruding regions (46–49) neighboring these recesses allow the element (60) to be positioned effectively.

In complementary fashion, this element (60) is composed of two pins (61, 62) arranged laterally with respect to the sole and substantially parallel to the portions of the contour of the shoe which they face. These pins (61, 62) are intended to be held captive in the binding located on the snowboard (not shown). These pins (61, 62) are joined by a portion forming an openworked plate having segments (63, 64) corresponding to the channels (43, 44) of the plate (40).

This component (60) is fastened in the sole by screwing, or any other equivalent means, through the holes (65) located opposite holes (45) made in the adaptation piece (40). These same holes (45) open onto a set of holes (15) which are made for this purpose in the upper face (7) of the housing (6) of the sole (3). As for the adaptation piece (20) described above, securing may take place directly in the sole or in an additional element (50) located inside the shoe.

In an advantageous form on its upper face, the adaptation piece includes lugs intended to plug the holes in the sole which correspond to other adaptation wedges dedicated to different bindings.

Figure 4:
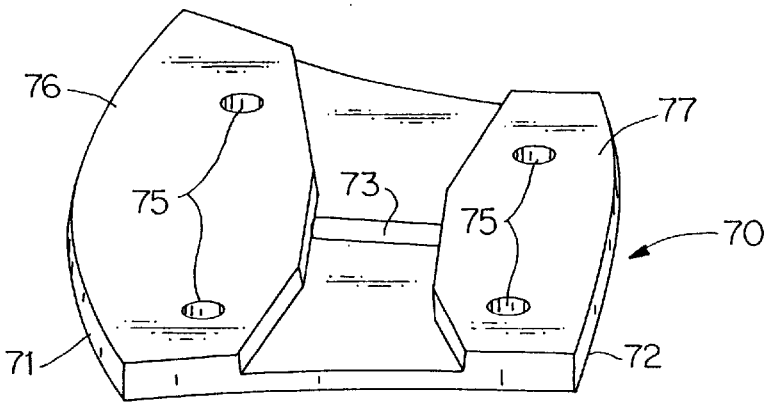

With the same principle, the snowboarding shoe according to the invention can receive a third adaptation piece (70), as illustrated in FIG. 4. Thus, this adaptation piece has front (71) and rear (72) sides complementary to the vertical steps (8 and 9) of the housing (6). This adaptation piece (70) includes thicker regions (76, 77) located to the front and to the rear and joined by the pin (73) for interacting with a binding. In order to allow securing, this adaptation piece (70) includes holes (75) facing holes made on the upper face (7) of the housing (6).

Figure 5:
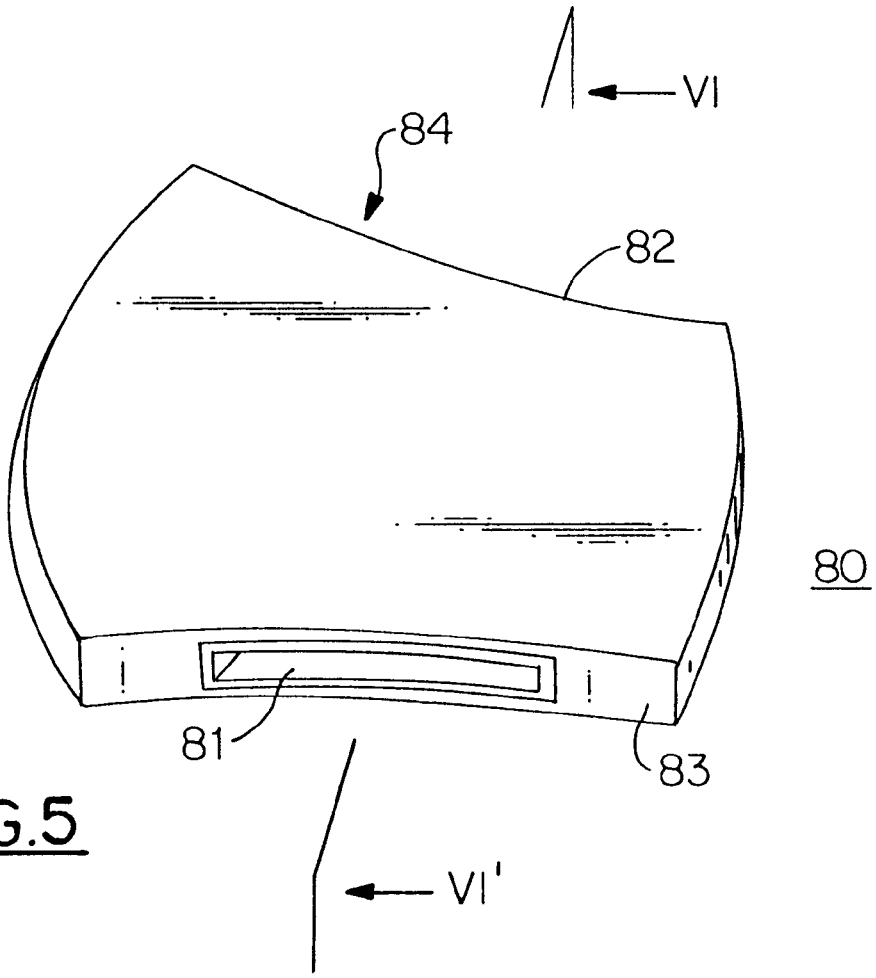
Figure 6:
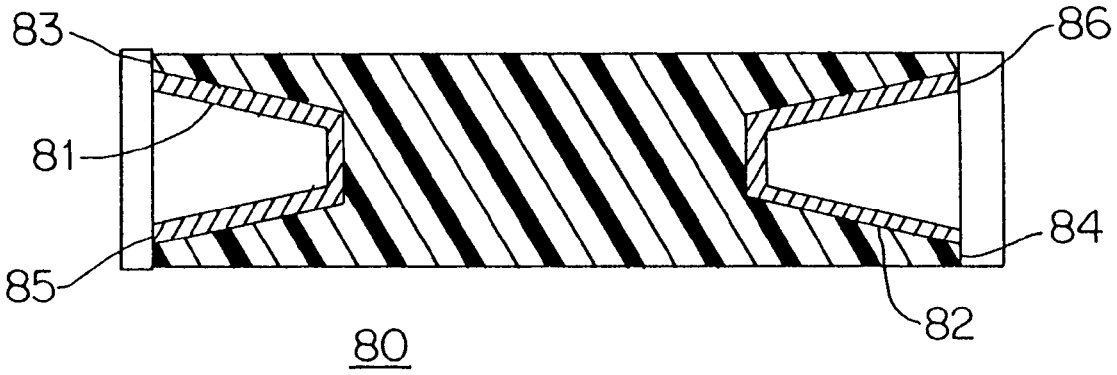
FIG. 6 is a sectional view of FIG. 5 along the arrows VI—VI'.
Figure 7:
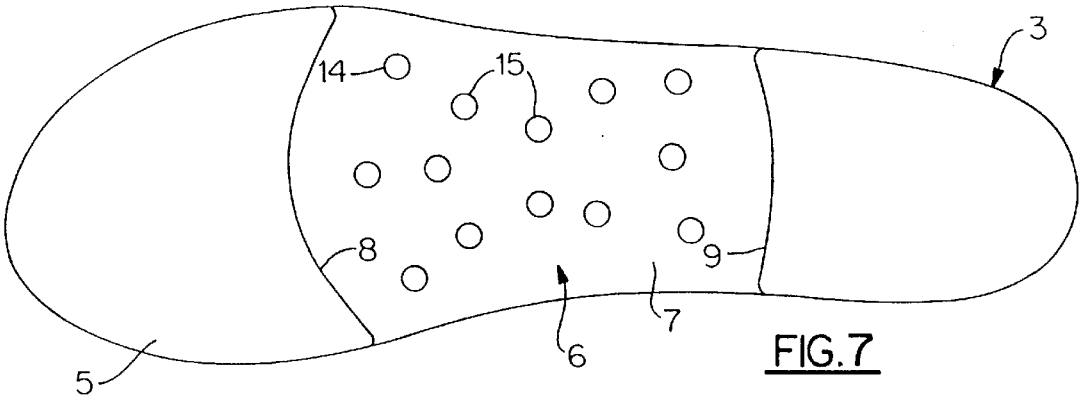
FIG. 7 is a bottom view of a bare sole.
Figure 8:
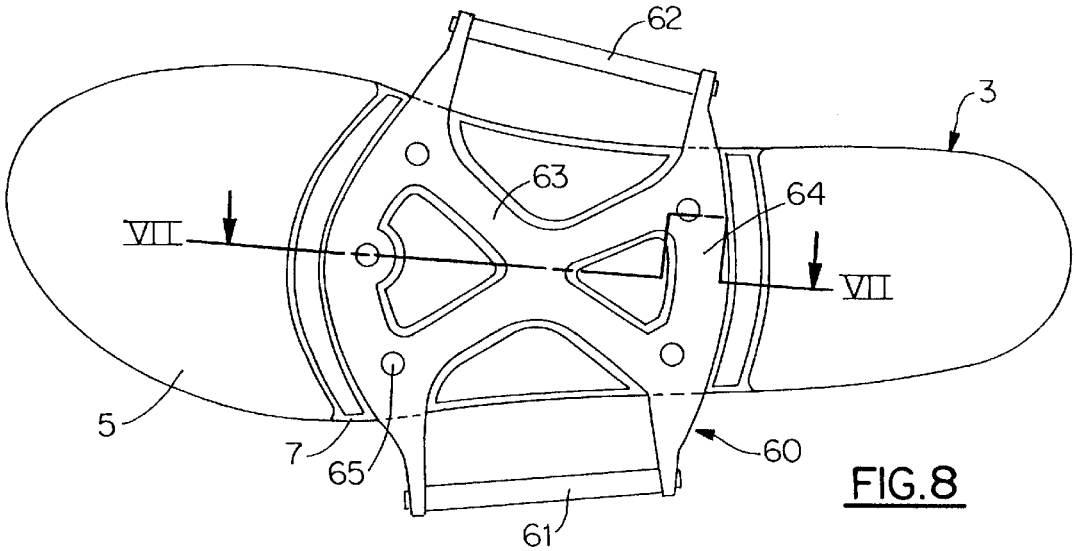
FIG. 8 is a bottom view of a sole equipped with the interaction components.

The snow boarding shoe according to the invention can also receive a fourth adaptation piece (80), as illustrated in FIG. 5. More precisely, on each of its side faces (83, 84) this adaptation piece (80) includes a recess (81, 82) arranged substantially halfway up, with a width of 3 to 10 centimeters and a height of 0.5 to 2 centimeters. As illustrated in FIG. 6, these lateral recesses (83, 84) receive two inserts (85, 86), made of a material with a rigidity much greater than that of the rest of the adaptation piece (80). Typically, these inserts (85, 86) are made of rigid plastic or metal. They are intended to be interpenetrated by transverse jaws (not shown) of the snowboard binding.

Of course, the invention encompasses many geometrical and architectural variants corresponding to the same principle, that is to say making it possible, using a single shoe, to mount various types of components for interacting with bindings of widely varied architecture, simply by replacing an adaptation piece.

The consequence of this is that the production of shoes of this type is more economical than the production of a range covering all the types of binding on the market. In addition, the user who practices snowboarding on boards which have different bindings can easily alter his shoes in order to adapt them to the binding of his choice.

I claim:

1. A snowboarding shoe system comprising:

a shoe having an upper portion and a sole having a central portion, said central portion having a housing; and, a plurality of adaptation pieces, each of said adaptation pieces comprising a means to receive a component for interacting with a binding located on a snowboard, wherein each of said adaptation pieces includes a unique means to receive a component for interacting with a binding, whereby a selected adaptation piece is removably secured to said housing, whereby said selected adaption piece comprising means to receive a component fits substantially within and is shaped to conform to said housing.

2. The snowboarding shoe as claimed in claim 1, wherein the housing opens laterally on the two sides of the sole.

3. The snowboarding shoe as claimed in claim 1, wherein said adaptation piece includes a front side and a rear side said front and rear sides being convex in shape.

4. The snowboarding shoe as claimed in claim 3, wherein the front and rear sides of the adaptation piece have identical curvatures and have a common center of curvature.

5. The snowboarding shoe as claimed in claim 4, wherein the housing has a diameter of between one hundred and five millimeters (105 mm) and one hundred and twenty millimeters (120 mm).

6. The snowboarding shoe as claimed in claim 1, wherein the housing has a depth of between fifteen millimeters (15 mm) and twenty millimeters (20 mm).

7. The snowboarding shoe as claimed in claim 1, wherein said adaptation piece includes a lower face, said lower face having a Plurality of recessed sections adapted to receive said components.

8. The snowboarding shoe as claimed in claim 1, wherein the sole has a plurality of holes allowing the securing of said component through a corresponding plurality of holes made through the adaptation piece.

9. The snowboarding shoe as claimed in claim 8, wherein the interaction components are secured to a rigid element arranged inside the shoe.

10. The snowboarding shoe as claimed in claim 1, wherein the components for interacting with the binding comprise a block protruding laterally on each side of the sole.

11. The snowboarding shoe as claimed in claim 1, wherein the components for interacting with the binding comprise a set of two pins which are oriented substantially along the longitudinal axis of the shoe.

* * * * *